US005597199A

United States Patent [19]

Hoffman et al.

[11] Patent Number: 5,597,199

[45] Date of Patent: Jan. 28, 1997

[54] OTTOMAN INCLUDING RETRACTABLE TABLE

[75] Inventors: D. Stephen Hoffman; Charles F. Lowe, both of High Point, N.C.

[73] Assignee: Ultra-Mek, Inc., Denton, N.C.

[21] Appl. No.: 375,561

[22] Filed: Jan. 12, 1995

Related U.S. Application Data

[63] Continuation of Ser. No. 84,429, Jun. 29, 1993, abandoned.

[51] Int. Cl.[6] ..... A47B 83/02

[52] U.S. Cl. ..... 297/144; 297/188.1; 297/423.41; 297/119

[58] Field of Search ..... 297/144, 135, 297/170, 173, 174, 1, 2, 118, 119, 423.1, 423.39, 423.41, 146, 105, 106, 310, 120, 129, 188.1, 188.08, 188.09, 188.01; 108/50; 312/235.2, 235.4

[56] References Cited

U.S. PATENT DOCUMENTS

| | | | |
|---|---|---|---|
| D. 151,983 | 12/1948 | Guertin | D15/8 |
| D. 151,984 | 12/1948 | Guertin | D15/8 |
| D. 160,390 | 10/1950 | Hubbert . | |
| 213,512 | 3/1879 | Landis . | |
| 577,138 | 2/1897 | Hubbard | 297/119 |
| 640,647 | 1/1900 | Gannett | 297/144 |
| 1,018,593 | 2/1912 | Swanson | 297/146 X |
| 1,509,863 | 9/1924 | Erickson . | |
| 2,577,741 | 12/1951 | Creveling et al. . | |
| 2,579,577 | 12/1951 | Hill | 155/172 |
| 2,582,703 | 1/1952 | Kirshbaum . | |
| 2,625,204 | 1/1953 | Reichman | 155/152 |
| 2,635,678 | 4/1953 | Basil | 297/146 |
| 2,696,870 | 12/1954 | Mende | 155/152 |
| 2,804,122 | 8/1957 | Baum | 297/233 X |
| 2,812,227 | 11/1957 | Hill . | |
| 2,838,097 | 6/1958 | Gleitsman et al. . | |
| 2,877,830 | 3/1959 | Smith . | |
| 2,950,753 | 8/1960 | Gleitsman et al. . | |
| 3,114,574 | 12/1963 | Pryale . | |
| 3,145,049 | 8/1964 | Duke | 297/105 |
| 3,227,112 | 1/1966 | Wiseman | 108/144 |
| 3,451,718 | 6/1969 | Kaufman . | |
| 3,942,835 | 3/1976 | Harrison | 297/61 |
| 4,083,599 | 4/1978 | Gaffney . | |
| 4,557,080 | 12/1985 | Walworth et al. | 297/332 X |
| 4,577,902 | 3/1986 | Crum | 297/85 |
| 4,669,778 | 6/1987 | Rogers, Jr. | 297/85 |
| 4,834,449 | 5/1989 | Engelman | 297/145 |
| 4,946,222 | 8/1990 | Matson | 297/344.17 |
| 5,087,094 | 2/1992 | Rogers, Jr. | 297/85 X |
| 5,160,183 | 11/1992 | Rusyniak | 297/119 X |
| 5,186,518 | 2/1993 | Pine | 297/85 |

FOREIGN PATENT DOCUMENTS

| | | | |
|---|---|---|---|
| 0002601 | 2/1900 | United Kingdom | 297/145 |
| 0240085 | 9/1925 | United Kingdom | 297/105 |

*Primary Examiner*—Milton Nelson, Jr.
*Attorney, Agent, or Firm*—Bell, Seltzer, Park & Gibson, P.A.

[57] ABSTRACT

An ottoman having a retractable table is disclosed herein. The table stores within the cavity of the ottoman and is movable to an extended position in which the table surface resides above and forwardly of the ottoman base.

44 Claims, 4 Drawing Sheets

OTTOMAN INCLUDING RETRACTABLE TABLE

This is a continuation of application Ser. No. 08/084,429, filed Jun. 29, 1993, entitled OTTOMAN INCLUDING RETRACTABLE TABLE and now abandoned.

FIELD OF THE INVENTION

This invention relates generally to footstool-type ottomans, and relates more specifically to ottomans having a retractable table stored therein.

BACKGROUND OF THE INVENTION

In many homes are found seating units, such as sofas and chairs, that include no convenient table-like surface for the placement of food and drink, reading and writing material, game boards, and the like. Typically seating units are placed adjacent coffee or end tables which are to provide support surfaces to serve these functions; however, the locations of these surfaces is not particularly convenient for an occupant of the seating unit. For example, if the occupant rests a plate of food or a drinking glass on a coffee table, he must lean forward from a seated position to retrieve it; this is somewhat awkward, particularly with seating units that employ deep, soft cushions. If the occupant wishes to eat from the plate or drink from the glass, he has two options. First, he can lean over the table while eating or drinking, which is even more awkward than simply leaning over the table to retrieve the plate. Second, the occupant can grasp the plate and carefully balance it as it travels with him to the seated position, after which he must support the plate as he eats. Either of these options is unsatisfactory, as the risk of the occupant spilling food or drink onto the table, the underlying floor (which is often carpeted), or the seating unit itself, is significant.

The situation is no better with an end table; the occupant must twist to retrieve the plate or glass from the end table and either consume in this awkward twisted position or balance the plate or glass as it travels and resides over the seating unit. Often the difficulty is exacerbated by the presence of an armrest on the end of the seating unit that the occupant must negotiate.

Further, the typical coffee table provides no surface between occupants seated on either end of a sofa that can serve as a card or game table. Thus occupants of the seating unit utilizing the table for this purpose must twist awkwardly to reach the table.

The underlying cause of these difficulties is the position of the table surface relative to the seating unit. On coffee tables, the table surface is too low and too far forward for easy access to the occupant of a seating unit. On end tables, the table surface is placed beside rather than directly in front of a seated occupant. However, furniture styles dictate that coffee tables provide table surfaces in these locations.

Quite often a seating unit will be accompanied by a footstool, such as an ottoman or hassock. Footstools are, of course, generally placed in front of the seating unit and thereby provide a surface upon which occupants of the seating unit can rest their feet. Footstools can serve additionally as storage receptacles. See, e.g., U.S. Pat. No. 2,812,227 to Hill.

Attempts have been made to provide an ottoman with a table-like surface so that some of the shortcomings described above are alleviated. For example, U.S. Pat. No. 3,227,112 to Wiseman discloses a stool with a completely removable top cushion. Beneath the top cushion are legs that extend vertically to support an separate auxiliary table surface. U.S. Pat. No. D151,984 to Guertin discloses a cylindrical hassock that splits longitudinally to expose a stationary coffee table stored within. U.S. Pat. No. D151,983 discloses a square hassock having a side wall attached to a coffee table-type surface; the side wall is pulled away from the hassock in drawer-like fashion and draws the table surface from within the hassock into its operable position therebeside. However, none of these footstools can provide a table surface in a suitable position for a seated occupant of an adjacent seating unit.

In view of the foregoing, it is a first object of this invention to provide an ottoman that further provides a table surface suitable for use by a seated occupant of an adjacent seating unit.

It is a second object of this invention to provide a means by which an ottoman can provide such a table surface.

SUMMARY OF THE INVENTION

These and other objects are satisfied by the present invention, which as a first aspect includes an ottoman convertible into a table comprising (a) an ottoman comprising a base having an internal cavity and a removable top cover; (b) a table surface; and (c) table surface extension means attached to the base and to the table surface for moving the table surface between a retracted position, in which the table surface resides within the cavity of the ottoman base, and an extended position, in which the table surface is disposed generally horizontally above and forwardly of the ottoman base.

A second aspect of the present invention is an ottoman convertible into a table comprising (a) an ottoman comprising a base having an internal cavity and a removable top cover; (b) ottoman cover opening means pivotally interconnected with the base for moving the top cover between a closed position, in which the cover is generally horizontally disposed above and adjacent the base, and an open position, in which the cover resides above and generally rearwardly of the base; (c) a table surface; and (d) table surface extension means pivotally interconnected with the base for moving the table between a retracted position, in which the table surface resides within the cavity of the ottoman base, and an extended position, in which the table surface is disposed generally horizontally above and forwardly of the ottoman base.

DETAILED DESCRIPTION OF THE INVENTION

The present invention will now be described herein in greater detail. The illustrated embodiment is not intended to be limiting; rather, this embodiment is included to provide those skilled in this art with a full and complete understanding of the invention.

The present invention relates to an ottoman having a retractable table stored within. The ottoman will generally be placed adjacent the seat portion of a seating unit, such as a couch, love seat, chair, pit-style sofa, and the like. The ottoman can, in the closed position, serve as a footrest; with the table in an extended position, it can provide a table surface to an occupant of the adjacent seating unit.

As used herein, "forward", "forwardly" and "front" all refer to the direction parallel with the floor extending from the ottoman toward the adjacent seating unit Conversely, the terms rear", "rearward", and "rearwardly" all refer to the direction parallel with the floor extending from the ottoman away from the seating unit. The term "lateral" refers to the direction parallel with the floor, perpendicular to the forward and rearward directions, and extending away from the center of the ottoman. The terms "medial," "inward", and "inboard" all refer to the direction that is the converse of the lateral direction, i.e., the direction parallel with the floor, perpendicular to the forward direction, and extending from the ottoman periphery toward its center.

Figure 1:
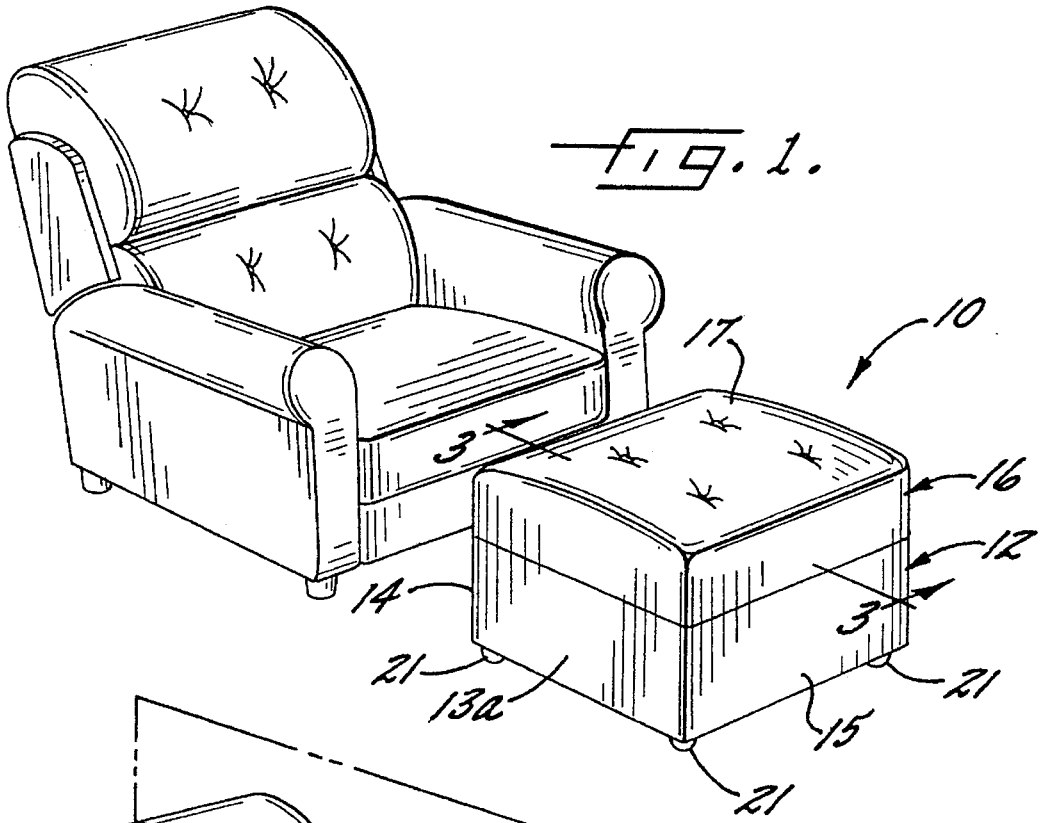
FIG. 1 is a perspective view of an ottoman having a retractable table surface placed adjacent a seating unit, wherein the removable ottoman cover is in place and the table surface is in its retracted position.
Figure 2:
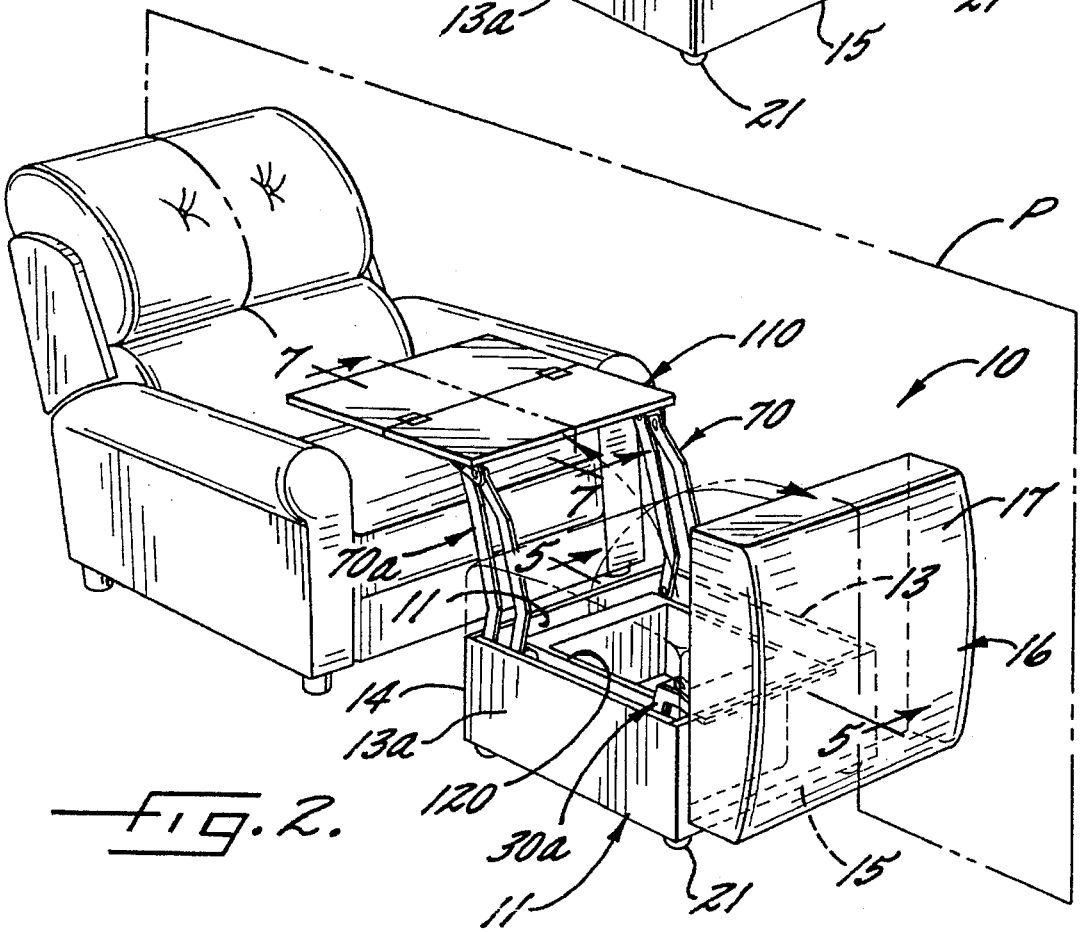
FIG. 2 is a perspective view of an ottoman having a retractable table surface showing the top cover in its open position and the table surface in its extended position.
Figure 3:
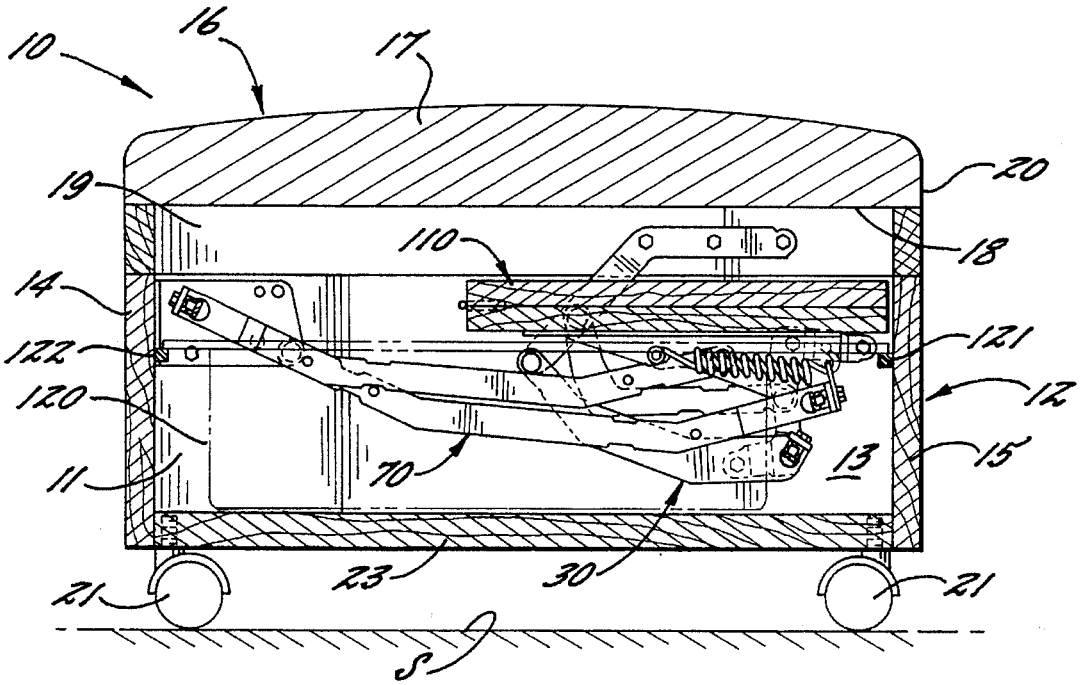
FIG. 3 is a side view of the ottoman with the table surface in its retracted position and the top cover in its closed position.
Figure 4:
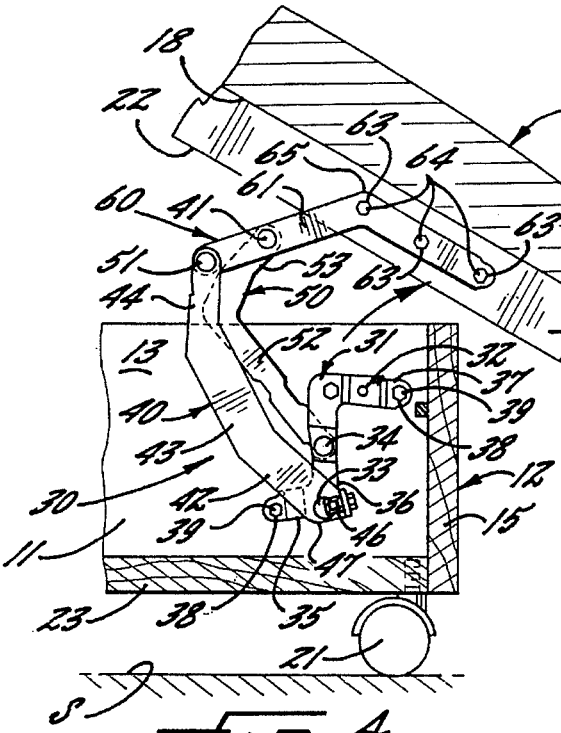
FIG. 4 is a side view of the ottoman with the top cover in an intermediate position between the open and the closed positions.
Figure 5:
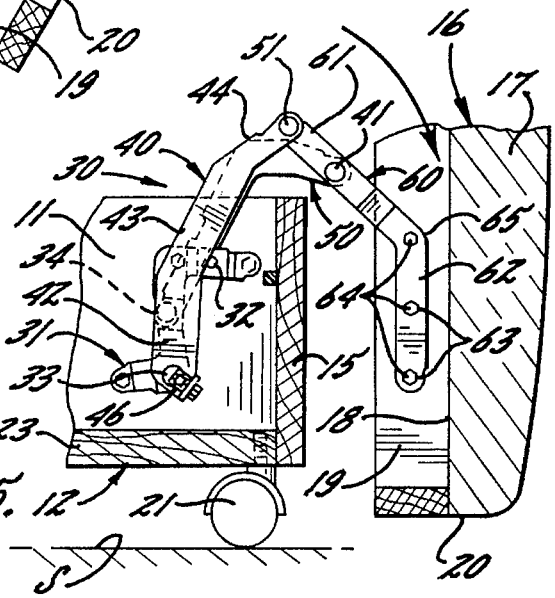
FIG. 5 is a side view of the ottoman with the top cover in its open position.

Referring now to the drawings, an ottoman illustrated broadly at 10 is shown in FIGS. 1 and 2. The ottoman 10 comprises a base 12, a top cover 16, a pair of cover mechanisms 30, 30*a*, a retractable table surface 110, a storage receptacle 120, and a pair of table surface mechanisms 70, 70*a*. The base 12 rests upon the floor through a quartet of casters 21, although it can also be configured to rest upon the underlying surface S through a plurality of legs, a lower floor-mating surface, and the like. The base 12 (FIGS. 3–7) includes a floor 23, lateral walls 13, 13*a*, a front wall 14, and a rear wall 15, which together form the periphery of the ottoman 10 and define a cavity 11 therein. The cover 16 comprises a top decorative cushion 17 which is attached to a lower plate 18. Each of a pair of rails 19, 19*a* (19*a* not shown) extends between the lateral front and rear portions of the underside of the plate 18. Although the ottoman illustrated herein has a rectangular footprint defined by walls 13, 13*a*, 14, and 15, those skilled in this art will understand that the shape of the ottoman footprint is not critical to the invention; any wall means that provides a defining external shape to the ottoman, such as square, circular, ovoid, and the like, is suitable for use with this invention.

Figure 7:
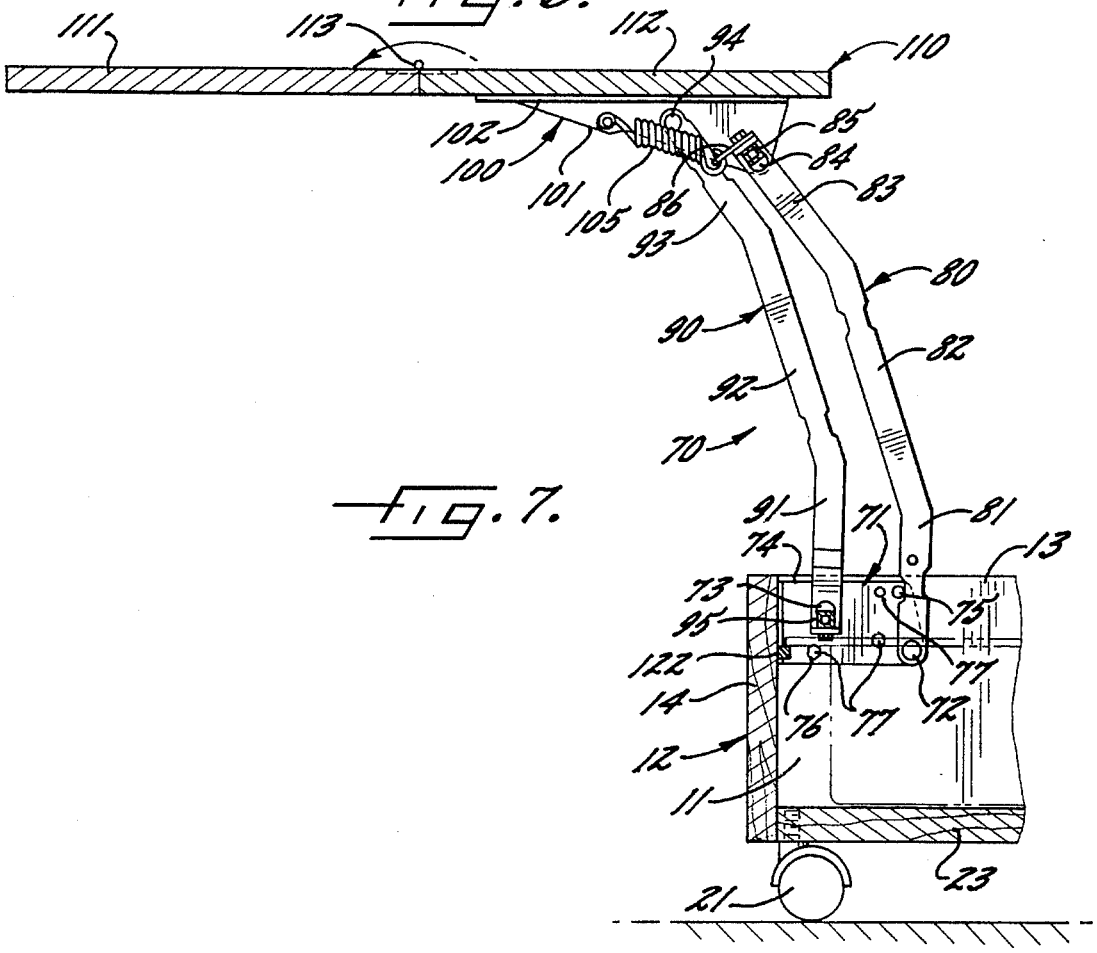
FIG. 7 is a side view of the ottoman in its fully extended position.

The cover 16 is movable between a closed position, wherein the cover 16 is generally horizontally disposed above and adjacent the base 12 (FIG. 3), and an open position, wherein the cover 16 resides rearwardly of the base 12 (FIG. 4) so that the retractable table surface 110 can be extended (FIG. 7). In this embodiment, in the open position, the cover 16 is generally vertically disposed rearwardly of the rear wall 15. As used herein, a generally vertical disposition of the cover 16 means that the cover is disposed so that the angle formed between the top surface of the cover and the underlying floor is between about 60 and 120 degrees. A vertical disposition in which the rear edge portion 20 of the cover 16 is adjacent to the surface S underlying the floor and the lower surfaces 22, 22*a* (22*a* not shown) of the rails 19, 19*a* confront the rear wall 15 is preferred, as in this position the cover 16 acts to stabilize the ottoman 10 against tipping. Additional stability aids in counterbalancing the ottoman 10 when the table surface 110 is in the extended position, and is particularly desirable when the ottoman 10 is mounted on casters. However, those skilled in this art will appreciate that although the illustrated vertical disposition is preferred, in the open position the top cover 16 can be disposed horizontally or at an intermediate angle therebetween that permits the extension of the table surface 110. Those skilled in this art will further appreciate that any number of mechanism configurations is suitable for moving the cover 16 between the closed position and an open position.

In addition, it should be apparent, that, although a removable cover that is permanently attached to the base is preferred, the cover 16 can be completely detachable for extension of the table. In a detachable configuration, the cover 16 can be secured in the closed position by any number of securing means such as mating pins or apertures, hook and loop substrates (often sold under the trademark VELCRO™), snaps, zippers, mating rails and grooves, and the like. It is preferred that some stabilizing means for counterbalancing the table 110 in the extended position, such as one or more weights placed in the rear of the base, or a particularly dense base material, be included in the ottoman if a detachable cover is employed.

The movement of the top cover 16 relative to the base 12 is controlled by the pair of cover mechanisms 30, 30*a*. Each of the cover mechanisms 30, 30*a* comprises a mounting bracket 31, a front pivot link 40, a rear pivot link 50, and a cover mounting bracket 60. The cover mechanisms 30, 30*a* are mirror images of one another about a plane of symmetry P (FIG. 2) parallel to and equidistant between the lateral walls 13, 13*a* of the base 12. In the interest of clarity and brevity, only the cover mechanism 30 will be described in detail herein; those skilled in this art will appreciate that this discussion is equally applicable to the mirror image cover mechanism 30*a*. Those skilled in this art will appreciate that, although the illustrated mechanism configuration is preferred, there are any number of alternative mechanism configurations, including both four-bar linkages and other types, that can control the movement of the cover 16 from the closed position to the open position illustrated herein. As used herein, a "four-bar linkage" is intended to mean a hinged chain of links having one rotational degree of freedom and equivalent structures, such as slider-crank mechanisms, see, e.g., Paul, *Kinematics and Dynamics of Planar Machinery* (Prentice-Hall, Inc. 1979), and is intended to encompass mechanical configurations having multiple interconnected four-bar linkages.

The mounting bracket 31 (FIGS. 4 and 5) comprises a generally horizontal lower arm 35, a central arm 36 fixed substantially perpendicularly to the rearmost portion of the lower arm 35 and extending upwardly therefrom, and an upper arm 37 fixed substantially perpendicularly to the uppermost end of the central arm 36 and extending rearwardly therefrom. The mounting bracket 31 includes at opposite ends apertures 38 which receive threaded fasteners 39 for fixed attachment to the rearward portion of the lateral wall 13 of the base 12. A vertex 47 positioned at the junction of the lower arm 35 and the central arm 36 includes the pivot 33 for pivotal interconnection with the front pivot link 30; also, a pivot 34 is positioned on the central arm 36 upwardly from the pivot 33 for pivotal interconnection with the rear pivot link 50. Although the mounting bracket 31 is illustrated herein, those skilled in the art will appreciate that any means that provides the pivots 33, 34 for pivotal movement of the front and rear pivot links 40, 50 relative to the lateral wall 13 is suitable for use with the present invention. Exemplary alternatives include a mounting plate, sleeve bushings recessed in or projecting from the lateral wall 13, or even apertures in the lateral wall 13 itself adapted to receive a threaded fastener, a pivot pin, and the like. The upper arm 37 includes in its central portion a stop pin that projects inwardly to interfere with and cease the motion of the rear pivot link 50 as it reaches the open position.

The rear pivot link 50 is pivotally attached to the mounting bracket 31 at the pivot 34 located on the central portion of the central arm 36 of the mounting bracket 31. Those skilled in this art will understand that this pivot, as well as the other pivots illustrated herein, can comprise any means which permits pivotal movement of one link upon another, including rivets, nuts and bolts, pivot pins, and the like. The rear pivot link 50 has a lower arm 52 and an upper arm 53 which are fixed to one another substantially perpendicularly. The upper arm 53 is pivotally connected with the cover mounting bracket 50 at a pivot 41 located at end of the upper arm 53 opposite its attachment thereof with the lower arm 52.

The front pivot link 40 is pivotally interconnected with the mounting bracket 31 at the pivot 33 located on the lower arm 35 of the mounting bracket 31. The front pivot link comprises a lower arm 42, a central arm 43, and an upper arm 44. The lower arm 42 is fixed to the central arm 43 so that the angle formed therebetween is approximately 160°. The upper arm 44 is fixed to the central arm 43 at approximately a 150° angle. At the end of the lower arm 42 opposite the central arm 43, a stabilizer tube 46 of square cross-section is fixed; this stabilizer 46 extends to a fixed attachment at the same location on the lower arm of the front pivot link of mechanism 30*a* on the opposite side of the pivotal ottoman 10. The stabilizer tube 46 acts to unify the movement of the mechanisms 30, 30*a*, and to provide lateral stability.

The cover mounting bracket 60 comprises a lower arm 61 and upper arm 62 fixed to the lower arm 61 so that the angle formed therebetween is approximately 135°. The upper arm 62 includes three mounting apertures 63 that receive threaded fasteners 64 for attachment of the mounting bracket 60 to the side rails 19, 19*a* of the cover 16. The mounting bracket 60 is attached to the rails 19, 19*a* so that the upper arm 62 is disposed generally horizontally in the closed position and the lower arm 61 extends downwardly and forwardly from the vertex 65. The lowermost end of the lower arm 61 includes the pivot 51 through which the cover mounting bracket 60 is pivotally interconnected with the front pivot link 40. Approximately halfway between the pivot 51 and the vertex 65 of the lower arm 61 and the upper arm 62 is the pivot 41 through which the cover mounting bracket 60 is pivotally interconnected with the rear pivot link 50. Those skilled in this art will appreciate that, although the cover mounting bracket 60 illustrated herein is preferred, any means that provides attachments for pivotal movement between the cover 16 and the front and rear pivot links 40, 50, such as sleeve bushings or direct attachment to apertures in the side rails 19, 19*a*, is suitable for use with this invention.

Turning now to the table surface mechanisms 70, 70*a* (FIGS. 6 and 7), the pair of table service mechanisms are mirror images of one another about the plane of symmetry P. Accordingly, the description herein will be limited to the table surface mechanism 70, with the understanding that all discussion is equally applicable to mechanism 70*a*. The table surface mechanism 70 comprises an ottoman mounting bracket 71, a rear pivot link 80, a front pivot link 90, a table surface mounting bracket and a spring 105. Those skilled in this art will appreciate that, although a mechanism of the configuration illustrated herein is preferred, any means, including four-bar linkages and other types of mechanisms, that can extend the table surface 110 from a retracted position within the cavity 11 of the ottoman 10 to an extended position in which the table surface 110 is disposed generally horizontally above and forward of the base 12 is suitable for use with this invention.

The table mounting bracket 71 is fixed through threaded fasteners 77, which extend through apertures 76, to the lateral walls 13 of the base 12. The table mounting bracket 71 is rectangular and includes a medially offset platform 74 in its upper forward corner. A stop pin 75 is fixed to the upper rearward portion of the mounting bracket 71. A pivot 72 for pivotal interconnection with the rear pivot link 80 is located in the lower rear corner of the mounting bracket 71; a second pivot 73 for pivotal interconnection with the front pivot link 90 is located near the center of the offset platform 74. Those skilled in this art will appreciate that, although the mounting bracket 71 illustrated herein is preferred, any means, such as those described above, for mounting the mechanism 70 and providing pivotal movement relative to the lateral wall 13 is suitable for use with this invention.

The rear pivot link 80 comprises a lower arm 81, a central arm 82 fixed to the lower arm 81 to form an angle of approximately 20 degrees therebetween, and an upper arm 83 fixed to the central arm 82 to form an angle of approximately 30° therebetween. The lowermost portion of the lower arm 81 is pivotally interconnected with the mounting bracket 71 at the pivot 72. Fixed to the end of the upper arm 83 at the end opposite to the central arm 82 is a stabilizer tube 85 of square cross-section. This table extends to a fixed attachment at the same location on the upper arm of the rear pivot link of the mechanism 70*a* on the opposite side of the ottoman 10. A square bracket 86 is fixed atop the stabilizer tube 85 for attachment to one end of the spring 105.

The front pivot link 90 comprises a lower arm 91, a central arm 92 fixed to the lower arm 91 to form an angle of approximately 20° therebetween, and an upper arm 93 fixed to the central arm 92 to form an angle of approximately 20° therebetween. The lower arm 91 is attached to this lowermost end to the mounting bracket 71 at the pivot 73. At the end of the lower arm 91 opposite the central arm 92, a stabilizer tube 95 of square cross-section is fixed; this tube 95 extends to a fixed attachment in the same location on its counterpart front pivot link of the mechanism 70*a* on the opposite side of the ottoman 10. Both stabilizer tubes 85 and 95 unify the movement of the mechanisms 70, 70*a* during operation and aid in resisting lateral movement of the table surface 110, particularly when it is in the extended position.

The mounting bracket 100 comprises substantially triangular vertical plate 101 and a horizontal plate 102 that merges substantially perpendicularly with the top edge of the vertical plate 101. The horizontal plate 102 includes apertures which receive threaded fasteners (not shown) for insertion into the lower surface of the table surface 110. The mounting bracket 100 is pivotally interconnected to the upper arm 83 of the rear pivot link 80 at a pivot 84, which is located on the rearmost and lowermost portion of the vertical plate 101. Also, the mounting bracket 100 is pivotally interconnected with the upper arm 93 of the front pivot link 90 at a pivot 94, which is positioned upwardly and forwardly of pivot 84. A mounting bracket of the illustrated configuration is preferred; however, those skilled in this art will appreciate that any means for mounting the table surface 110 that provides pivotal interconnection with the rear and front pivot links 80, 90 is suitable for use with this invention. The spring 105 is attached at the forward end of the horizontal plate 101. The spring is selected to be relaxed when the table surface 110 is in the extended position and to be in tension when the table surface 110 is in the retracted position.

The table surface 110 comprises a front half 111 and a rear half 112. The halves are attached through a hinge 113 that pivotally interconnects the rear edge of the front half 111 with the front edge of the rear half 112. In the retracted position, the front half 111 rests atop the rear half 112; in the extended position, the front half pivots about the hinge 113 to reside forward of and coplanar with the rear half 112. Although this hinged configuration is preferred to permit the storage of a larger table surface and to permit access to the storage receptacle 120 when the table is still in the retracted position, it should be appreciated that an unhinged single-section table can also be used with the present invention. In addition, although it is preferred that the table surface 110 be generally horizontally disposed in the retracted position and maintain a generally horizontal disposition throughout its movement to the extended position, those skilled in this art will appreciate that the table surface 110 can be disposed vertically or at an angle relative to horizontal and still be suitable for use with this invention.

The storage receptacle 120 resides within the cavity 11. The storage receptacle 120 rests upon a block shelf 121 which is fixed directly to the rear wall 15, and also rests upon a block shelf 122 that is fixed to the front wall 14. The receptacle 120 can be a single unit or can be subdivided into any number of compartments as desired.

Extension of the table surface 110 with the ottoman 10 in the closed position (FIG. 3) begins with the operator providing an upward force on the forward edge of the cover 16. This force draws the cover 16 and the cover mounting bracket 60 fixed thereto upwardly and rearwardly. The upward and rearward movement of the pivots 41 and 51 causes rotation of the rear pivot link 50 and front pivot link 30 about pivots 41 and 51, respectively, so that the upper arms 53 and 44 move upwardly and rearwardly. This action continues, with the cover 16 gradually rotating from a generally horizontal disposition to a generally vertical disposition, until the center arm 43 of the front pivot link 40 strikes the stop pin 32 as the cover 16 reaches the open position (FIG. 5), wherein the cover 16 is generally vertically disposed, the rear edge portion 20 of the cover 16 is adjacent to the underlying surface S, and the lower surfaces 22, **22*a* of the rails 19, 19*a* confront the rear wall 15. In this position the cover 16 is sufficiently removed from the base 12 that the storage receptacle 70** can be accessed by the operator.

It is noteworthy that, because of the tripartite configuration of the rear pivot link 40 and the front pivot link 30 and the angled configuration of the cover mounting bracket 50, very little of the material comprising these links is visually exposed above the base 12. This improves the appearance of the ottoman with the cover 16 in the open position. Also, there are no "pinch-points" created during the opening of the cover 16 between these links and the rear wall 15; instead, the tripartite configuration of the front pivot link 40 and the rear pivot link 50 and the angled configuration of the cover mounting bracket 60 cause these links to be spaced away from the internal and external surfaces and the top edge of the rear wall 15. Preferably, the distance between these links and the wall is at least 1.5 inches. Those skilled in this art will appreciate that smoothly curved links that approximate the tripartite profile of the front and rear pivot links 40, 50 and the angled profile of the cover mounting bracket 60 could also be employed with this invention and provide the same benefits as the links illustrated herein.

Figure 6:
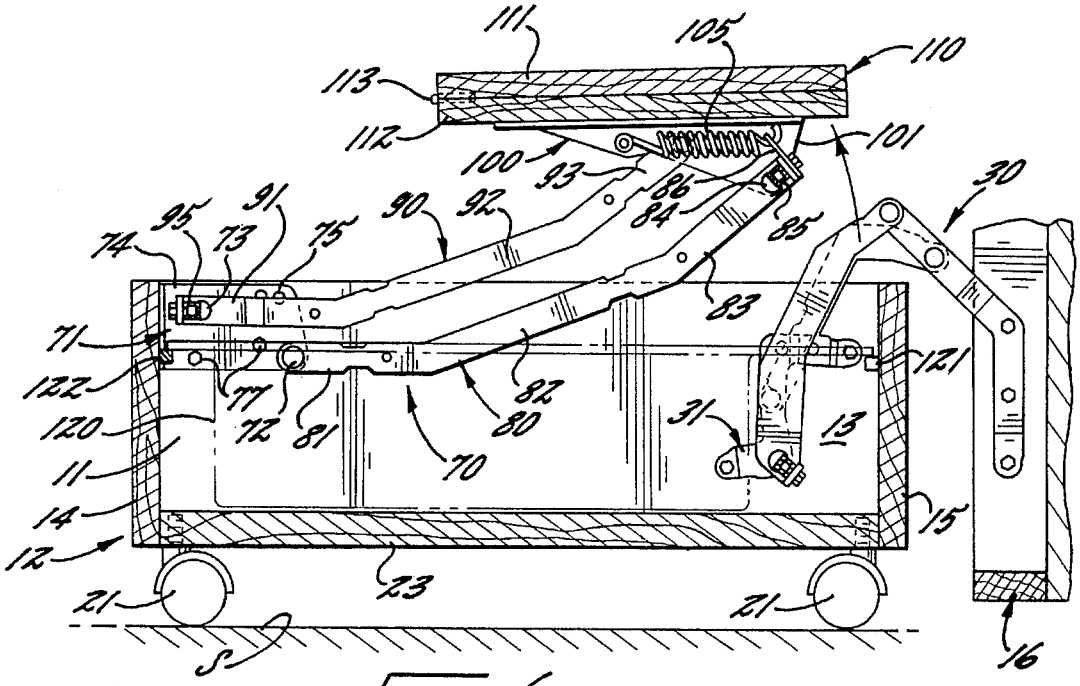
FIG. 6 is a side view of the ottoman with the top cover in its open position and the table in an intermediate position between the retracted and the extended positions.

To move the table surface 110 from the retracted position of FIG. 6 to the extended position of FIG. 7, the operator applies an upward and slightly forward force to the table surface 110 as it rests upon the upper edges of the storage receptacle 110. In this position, the spring 105 is in tension and thus biases the table surface 110 toward the extended position. Application of this force causes the table surface mounting bracket 100 that is fixed to the underside of the table surface 110 to similarly move upward and forward. This action draws the front pivot link 90 and the rear pivot link 80 about pivots 73 and 72, respectively. The table surface 110 reaches the extended position and ceases further movement as the lower arm 81 of the rear pivot link 80 strikes the stop pin 75. The table surface 110 can then be extended further forward by pivoting the front half 111 about hinge 113 until the rear edge of the front half 111 meets the front edge of the rear half 112. In the fully extended position, the major portion of the table surface 110 is forward of the front wall 14 of the base 12.

The advantages conferred by the tripartite structure of the front pivot link 90 can be best seen in FIG. 7. By bending rearwardly, the front pivot link 90 provides additional leg room for a seating unit occupant. In addition, pinch-points between this link and the front wall 14 of the base are avoided.

Those skilled in this art will note that the pivots 72, 73, 84, and 94 are positioned so that in the retracted position, the extended position, and all intermediate positions, lines drawn between the pivots form a parallelogram. Consequently, the table surface 110 is maintained in a generally horizontal disposition through its movement between the retracted and extended positions. This configuration is preferred in that it permits the table surface 110 to support an item in any position between and including the retracted and extended positions, although those skilled in this art will appreciate that any four-bar linkage means that will move the table surface 110 from a stored position inside the cavity 11 of the base 12 to an extended position above and forward of the base 12. It is preferred that, in the extended position, the table surface 110 is between about 20 and 30 inches, and more preferably between 22 and 26 inches above the floor. This height provides a convenient and comfortable table surface for an occupant of most seating units. The front edge of the table surface 110 should be between about 16 and 25 inches forward of the front wall 14 of the base 12. In this position, the major portion of the table surface 110 is forward of the front wall 14 of the base 12 and thus is located for convenient use by an occupant.

Figure 8:
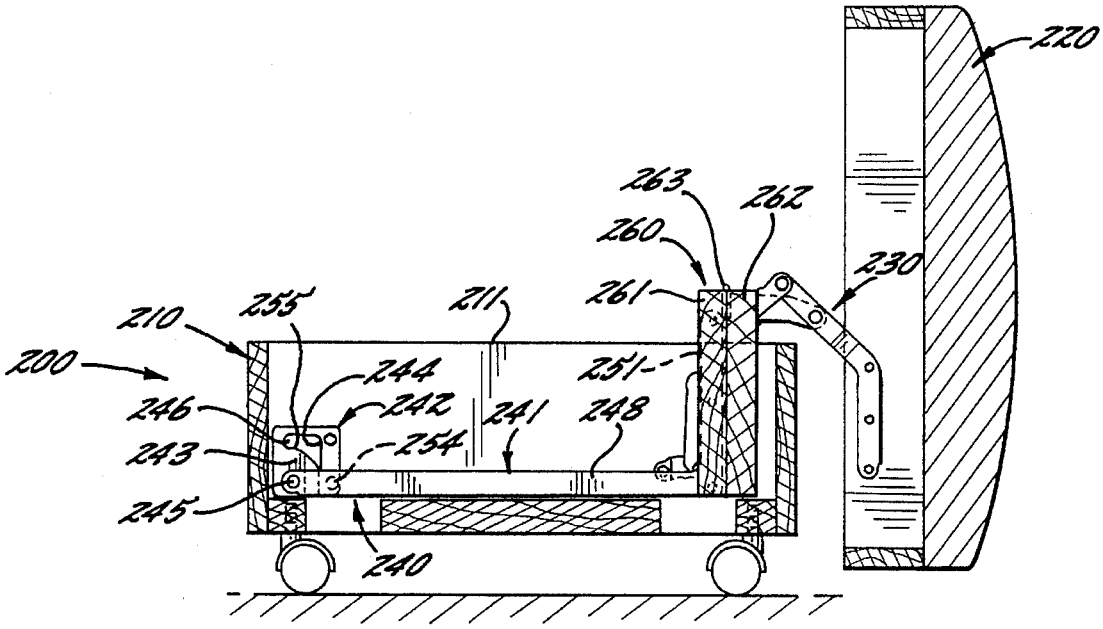
FIG. 8 is a side view of an additional embodiment of the ottoman showing the table surface in its retracted position.
Figure 9:
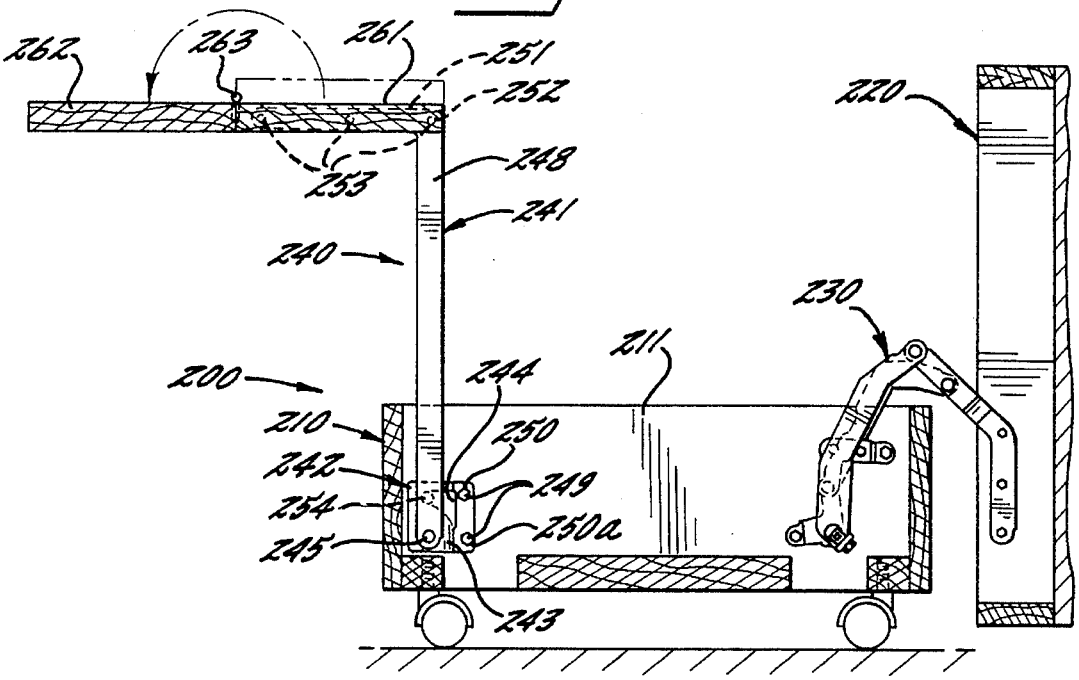
FIG. 9 is a side view of the ottoman of FIG. 8 showing the table in the extended position.

A second embodiment of the present invention is shown in FIGS. 8 and 9. The ottoman 200 illustrated therein comprises a base 210, a cover 220, a pair of cover mechanisms 230, **230*a* (230*a* not shown), a table support linkage 240, and a table surface 260. The base 210, cover 220, and cover mechanisms 230, 230***a* are identical to those embodied in FIGS. 1–7, and the discussion above regarding these elements is equally applicable here.

The table surface linkage 240 comprises a link 241 and a base mounting bracket 242. The base mounting bracket 242 is fixed to a lateral wall 211 of the base 210 through threaded fasteners 249, which are inserted through apertures 250 positioned on the rearward edge of the bracket 242. The bracket 242 further includes an inwardly offset shelf 243. A substantially triangular aperture 244 is positioned within the shelf 243 so that one side is substantially vertical and its opposite angle points forwardly. At the forwardmost portion of the aperture 244 is an inlet 246 which narrows slightly at its rearward opening 255. In addition, a pivot 245 is positioned on the shelf 243 beneath the inlet 246; this pivot provides a pivotal interconnection between the mounting bracket 242 and the link 241.

The link 241 comprises a swing arm 248 and a support link 251 (shown in phantom line) fixed substantially perpendicularly to the end of the swing link 241 opposite the pivot 245. The support link includes three securing apertures 252 that receive threaded fasteners 253 for fixed attachment to the table surface 250. Those skilled in this art will recognize that, although an L-shaped link is illustrated herein, the link 241 can take any shape that can both fold within the cavity of the ottoman 200 with the cover 220 in the closed position and extend to provide a table surface in the desired position. The link 241 also includes a stop pin 254 near pivot 245. The stop pin 254 is sized to be slightly larger than the opening 255 of the inlet 246 but slightly smaller than the inlet 246 so that it can be captured within the inlet 246. Those skilled in this art will appreciate that any means that can retain the link 241 in a desired extended position, such as a chain, an additional linkage, and the like, can be suitably employed with this invention.

The table surface 260 comprises a rearward section 261, a forward section 262, and a hinge 263 which pivotally interconnects the forward edge of the rearward section 261 with the rearward edge of the forward section 262.

In its retracted position (FIG. 8), the swing arm 248 of the link 241 is horizontally disposed, the stop pin 254 is adjacent the lower securing aperture 250*a*, the forward section 262 of the table surface 260 is folded about hinge 263 to contact the rear surface 261, and both the forward and rear sections of the table surface 260 are vertically disposed and reside in the rear portion of the cavity within the base 210. The vertical disposition of the table surface 260 is preferred; however, the table surface 260 can be stored in a horizontal or angled position with a modified link 241 and be suitable for use with the invention.

To move the table surface 260 to its extended position, first the cover 220 of the ottoman 200 is moved to its open position (FIG. 8) as described above for the embodiment of FIGS. 1–7. The operator then applies an upwardly-directed force to the table surface 260. This force causes the table surface 260 to rise and move forwardly as link 241 pivots about pivot 245. As the link 241 reaches a position in which the longitudinal axis of the swing arm 248 forms an angle of approximately 30 degrees with the underlying surface S, the stop pin 245 protrudes into the lower rearward corner of the aperture 244. The table surface 260 continues to travel upwardly and rearwardly until the stop pin 245 reaches the narrowed opening 255 of the inlet 246. Because the opening 255 is slightly narrower than the stop pin 254, the stop pin 254 must be forced between the sides of the opening 255 to cause them to separate. Once past the opening 255, the stop pin 254 resides within the inlet 246 and is retained therein by virtue of its being larger than the opening 255. In this position the swing arm 248 of the link 241 is substantially vertical, and the table surface 260 is substantially horizontal. The forward section 262 of the table surface 260 is then inverted about the hinge 263 to reside forwardly from and coplanar with the rear section 261. In this extended position (FIG. 9), the table surface 260 resides above and forwardly from the front wall of the base 210, and thus is positioned to provide a suitable surface for an occupant of an adjacent seating unit for eating, reading, and the like.

The foregoing embodiments are illustrative of the present invention, and are not to be construed as limiting thereof. The invention is defined by the following claims, with equivalents of the claims to be included therein.

That which is claimed is:

1. An ottoman convertible into a table comprising:

an ottoman comprising:

a base having an internal cavity; and a removable top cover;

a table surface having a front edge;

table surface extension means attached to said base and said table surface for moving said table between a retracted position, in which said table surface resides within the cavity of said ottoman base, and an extended position, in which a major portion of said table surface is disposed generally horizontally above and forwardly of said ottoman base;

said table surface extension means comprises four bar linkage means, said four bar linkage means comprising:

base mounting means fixed to said base;

a forward pivot link pivotally interconnected to said base mounting means at a first pivot;

a rearward pivot link pivotally interconnected with said base mounting means at a second pivot positioned rearwardly of said first pivot; and table surface mounting means attached to said table surface, pivotally interconnected to said forward pivot link at a third pivot, and pivotally interconnected to said rearward pivot link at a fourth pivot positioned rearwardly of said third pivot; and counterbalancing means attached to said base for counterbalancing the weight of said table surface when said table surface is in the extended position and thereby prevent toppling of the ottoman.

2. An ottoman according to claim 1, wherein said removable top cover is interconnected with said base and is movable between a closed position, in which said top cover is disposed atop said base, and an open position, wherein said top cover is positioned rearwardly from said base.

3. An ottoman according to claim 1, wherein said table surface extension means is configured so that said table surface maintains a generally horizontal position as said table surface moves between the retracted position and the extended position.

4. An ottoman according to claim 1, wherein said table surface extension means is configured so that in the extended position, said front edge of said table surface extends to a position between about 20 and 30 inches above the floor and between about 16 and 25 inches forwardly of said base.

5. An ottoman according to claim 1, wherein said table surface extension means further comprises stop means for halting the movement of said table surface as said table surface reaches the extended position.

6. An ottoman according to claim 1, further comprising a storage receptacle within the cavity of said base.

7. An ottoman according to claim 1, wherein said table surface comprises a first front section having a rear edge and a second rear section having a front edge, said front edge of said rear section being pivotally interconnected with said rear edge of said front section.

8. An ottoman according to claim 7, wherein in the retracted position, said front section and said rear section are generally vertically disposed.

9. An ottoman according to claim 7, wherein in the retracted position, said front section and said rear section are generally horizontally disposed.

10. An ottoman convertible into a table comprising:

an ottoman comprising:

a base having an internal cavity; and
a removable top cover;

a table surface; and table surface four-bar linkage means attached to said base and said table surface for moving said table between a retracted position, in which said table surface resides within the cavity of said ottoman base, and an extended position, in which a major portion of said table surface is disposed generally horizontally above and forwardly of said ottoman base, said table surface four bar linkage means comprising:

base mounting means fixed to said base;

a forward pivot link pivotally interconnected to said base mounting means at a first pivot;

a rearward pivot link pivotally interconnected with said base mounting means at a second pivot positioned rearwardly of said first pivot; and table surface mounting means attached to said table surface, pivotally interconnected to said forward pivot link at a third pivot, and pivotally interconnected to said rearward pivot link at a fourth pivot positioned rearwardly of said third pivot.

11. An ottoman convertible into a table comprising:

an ottoman comprising:

a base having an internal cavity;

a removable top cover having a rear edge portion; and ottoman cover four-bar linkage means pivotally interconnected with said base and said top cover for moving said top cover between a closed position, in which said top cover is generally horizontally disposed above and adjacent said base, and an open position, in which said top cover is disposed generally vertically and resides generally rearwardly of and in noncontacting relationship with said base, and said top cover rear edge portion is positioned adjacent a surface underlying said base;

a table surface; and table surface extension means attached to said base and said table surface for moving said table between a retracted position, in which said table surface resides within the cavity of said ottoman base, and an extended position, in which a major portion of said table surface is disposed generally horizontally above and forwardly of said ottoman base.

12. An ottoman according to claim 11, wherein said table surface has a front edge, and wherein said table surface extension means is configured so that in the extended position, said front edge of said table surface extends to a position between about 20 and 30 inches above the floor and between about 16 and 25 inches forwardly of said base.

13. An ottoman according to claim 11, wherein said table surface extension means further comprises stop means for halting the movement of said table surface as said table surface reaches the extended position.

14. An ottoman according to claim 11, further comprising a storage receptacle within the cavity of said base.

15. An ottoman according to claim 11, wherein said table surface extension means comprises four bar linkage means.

16. An ottoman according to claim 15, wherein said table surface four bar linkage means is configured so that in the retracted position, said table surface is generally horizontally disposed.

17. An ottoman according to claim 15, wherein said table surface four bar linkage means is configured so that said table surface maintains a generally horizontal position as said table surface moves between the retracted position and the extended position.

18. An ottoman according to claim 15, wherein said table surface four bar linkage means comprises:

base mounting means fixed to said base;

a forward pivot link pivotally interconnected to said base mounting means at a first pivot;

a rearward pivot link pivotally interconnected with said base mounting means at a second pivot positioned rearwardly of said first pivot; and table surface mounting means attached to said table surface, pivotally interconnected to said forward pivot link at a third pivot, and pivotally interconnected to said rearward pivot link at a fourth pivot positioned rearwardly of said third pivot.

19. An ottoman according to claim 11, wherein said table surface comprises a first front section having a rear edge and a second rear section having a front edge, said front edge of said rear section being pivotally interconnected with said rear edge of said front section.

20. An ottoman according to claim 19, wherein in the retracted position, said front section and said rear section are generally vertically disposed.

21. An ottoman according to claim 19, wherein in the retracted position, said front section and said rear section are generally horizontally disposed.

22. An ottoman convertible into a table comprising:

an ottoman comprising:

a base having an internal cavity;

a removable top cover; and ottoman cover four-bar linkage means pivotally interconnected with said base and said top cover for moving said cover between a closed position, in which said top cover is generally horizontally disposed above and adjacent said base, and an open position, in which said top cover resides generally rearwardly of said base;

a table surface; and table surface four-bar linkage means pivotally interconnected with said base and with said table surface for moving said table surface between a retracted position, in which said table surface resides within the cavity of said ottoman base, and an extended position, in which a major portion of said table surface is disposed generally horizontally above and forwardly of said ottoman base.

23. An ottoman according to claim 22, wherein said top cover has a rear edge and a lower surface, said base includes a substantially upright rear wall portion, and said ottoman cover four-bar linkage means is configured so that in the open position, said rear edge of said top cover is adjacent the underlying surface supporting said base and said lower surface of said ottoman cover confronts said rear wall portion of said base.

24. An ottoman according to claim 22, wherein said table surface four bar linkage means is configured so that in the retracted position, said table surface is generally horizontally disposed.

25. An ottoman according to claim 22, wherein said table surface four bar linkage means is configured so that said table surface maintains a generally horizontal position as said table surface moves between the retracted position and the extended position.

26. An ottoman according to claim 22, wherein said table surface has a front edge, and wherein said table surface four-bar linkage means is configured so that in the extended position, said front edge of said table surface extends to a position between about 20 and 30 inches above the floor and between about 16 and 25 inches forwardly of said base.

27. An ottoman according to claim 22, wherein said table surface four-bar linkage means further comprises stop means for halting the movement of said table surface as said table surface reaches the extended position.

28. An ottoman according to claim 22, wherein said table surface four bar linkage means comprises:

base mounting means fixed to said base;

a forward pivot link pivotally interconnected to said base mounting means at a first pivot;

a rearward pivot link pivotally interconnected with said base mounting means at a second pivot positioned rearwardly of said first pivot; and table surface mounting means attached to said table surface, pivotally interconnected to said forward pivot link at a third pivot, and pivotally interconnected to said rearward pivot link at a fourth pivot positioned rearwardly of said third pivot.

29. An ottoman according to claim 32, further comprising a storage receptacle within the cavity of said base.

30. An ottoman according to claim 22, wherein said table surface comprises a first front section having a rear edge and a second rear section having a front edge, said front edge of said rear section being pivotally interconnected with said rear edge of said front section.

31. An ottoman according to claim 30, wherein in the retracted position, said front section and said rear section are generally vertically disposed.

32. An ottoman according to claim 30, wherein in the retracted position, said front section and said rear section are generally horizontally disposed.

33. An ottoman convertible into a table comprising:

an ottoman comprising:

a base having an internal cavity; and a removable top cover;

a table surface; and table surface four bar linkage means attached to said base and said table surface for moving said table between a retracted position, in which said table surface resides within the cavity of said ottoman base, and an extended position, in which a major portion of said table surface is disposed generally horizontally above and forwardly of said ottoman base.

34. An ottoman according to claim 33, wherein said table surface four bar linkage means is configured so that in the retracted position, said table surface is generally horizontally disposed.

35. An ottoman according to claim 33, wherein said table surface four bar linkage means is configured so that said table surface maintains a generally horizontal position as said table surface moves between the retracted position and the extended position.

36. An ottoman according to claim 33, wherein said table surface has a front edge, and wherein said table surface four bar linkage means is configured so that in the extended position, said front edge of said table surface extends to a position between about 20 and 30 inches above the floor and between about 16 and 25 inches forwardly of said base.

37. An ottoman according to claim 33, wherein said table surface four bar linkage means further comprises stop means for halting the movement of said table surface as said table surface reaches the extended position.

38. An ottoman according to claim 33, wherein said table surface four bar linkage means comprises:

base mounting means fixed to said base;

a forward pivot link pivotally interconnected to said base mounting means at a first pivot;

a rearward pivot link pivotally interconnected with said base mounting means at a second pivot positioned rearwardly of said first pivot; and table surface mounting means attached to said table surface, pivotally interconnected to said forward pivot link at a third pivot, and pivotally interconnected to said rearward pivot link at a fourth pivot positioned rearwardly of said third pivot.

39. An ottoman according to claim 33, further comprising a storage receptacle within the cavity of said base.

40. An ottoman according to claim 33, wherein said ottoman further comprises ottoman cover opening means pivotally interconnected with said base and said top cover for moving said top cover between a closed position, in which said top cover is generally horizontally disposed above and adjacent said base, and an open position, in which said top cover resides generally rearwardly of said base.

41. An ottoman according to claim 40, wherein said ottoman cover opening means is configured so that in the open position, said top cover is generally vertically disposed.

42. An ottoman according to claim 41, wherein said top cover has a rear edge, and wherein in the open position said rear edge is adjacent to the floor.

43. An ottoman according to claim 33, wherein said table surface comprises a first front section having a rear edge and a second rear section having a front edge, said front edge of said rear section being pivotally interconnected with said rear edge of said front section.

44. An ottoman according to claim 43, wherein in the retracted position, said front section and said rear section are generally horizontally disposed.

* * * * *